United States Patent [19]

Weaver et al.

[11] 4,285,506

[45] Aug. 25, 1981

[54] CLOTH SPREADING AND CLAMPING APPARATUS

[76] Inventors: Nyal J. Weaver, 12345 Colby Dr., Mishawaka, Ind. 46544; William F. Teal, 16630 County Rd. 10, Bristol, Ind. 46507

[21] Appl. No.: 741,394

[22] Filed: Nov. 12, 1976

[51] Int. Cl.[3] ..... B65H 29/46

[52] U.S. Cl. ..... 270/30

[58] Field of Search ..... 270/30–31

[56] References Cited

U.S. PATENT DOCUMENTS

| | | | |
|---|---|---|---|
| 2,587,811 | 3/1952 | Bieber | 270/30 |
| 2,795,416 | 6/1957 | Bax | 270/31 |
| 3,942,783 | 3/1976 | Neef | 270/30 |

FOREIGN PATENT DOCUMENTS

| | | | |
|---|---|---|---|
| 666426 | 2/2952 | United Kingdom | 270/31 |
| 952244 | 3/1964 | United Kingdom | 270/3 |

*Primary Examiner*—Edgar S. Burr
*Assistant Examiner*—A. Heinz
*Attorney, Agent, or Firm*—Craig and Antonelli

[57] ABSTRACT

An improved cloth clamping or catching apparatus is provided for a cloth spreading arrangement of the type having a table with a cloth spreader reciprocally moveable along the length of the table for laying down superimposed layers of cloth with reversing folds in the cloth at the respective ends of the spreader travel path. A catcher carriage is provided for at least one of the catchers disposed at the cloth pile ends for clamping the cloth against the table. The catcher carriage includes a pair of guide wheels engageable with a guide track for the spreader, as well as a pair of support wheels engageable directly with the table surface for accommodating easy, longitudinal adjusting movement of the catcher. A carriage brake is provided which includes a single hand-operable spindle which is rotatable to simultaneously engage brake shoes against opposite sides of the table to clamp the carriage in an adjusted position. The cross frame for the catcher carrier, as well as the brake rod for the catcher carrier breaking system are disposed sufficiently above the level of the table surface so as to accommodate step-wise stacking of cloth, with the catcher and carrier moveable over already folded piles of cloth so as to accommodate cloth spreading for various lengths without interruption or cutting of the cloth being required.

31 Claims, 3 Drawing Figures

CLOTH SPREADING AND CLAMPING APPARATUS

BACKGROUND AND SUMMARY OF THE INVENTION

Cloth spreading machines of the type having a spreader mounted for movement along the length of a table in respective opposite directions to lay-down superimposed layers of cloth with reversing folds at respective opposite ends of the travel path of the spreader have been known for some time. For example, U.S. Pat. Nos. 2,520,895 and 3,622,146 disclose such arrangements.

With such cloth spreading machines, it is also known to provide cloth clamping mechanisms or cloth "catchers" at respective opposite ends of the travel path of the spreading machine, as also evidenced by the above-noted U.S. Pat. Nos. 2,520,895 and 3,622,146.

Prior arrangements of catchers have included one catcher at one end which is affixed to the table in a rather permanent manner. The opposite end catcher has been designed in certain prior art arrangements so as to be slidably moveable along the table surface to accommodate adjustment of the spreader travel path, and thereby the folding length of the cloth being spread. Such prior art adjustable catching mechanisms have utilized C-clamps or other types of clamps for clamping the slidably moveable catcher to the table structure at the respective adjusted positions thereof as shown, for example, in said U.S. Pat. No. 3,622,146.

Longitudinal adjustment of these prior art type catcher mechanisms in most cases required: (i) the disconnection of a plurality of C-clamps or other screw clamp connections, (ii) the sliding of the catcher mechanism along the length of the table, (iii) the realignment of the catcher mechanism at the adjusted position so as to be in a correct position across the width of the table (namely perpendicular to the longitudinal adjusting direction of the table); and (iv) the clamping of the catcher in the new adjusted position. This longitudinal adjustment required a considerable length of time and, due to the relatively large bulk and weight of these catcher mechanisms, two persons were utilized to make adjustment changes of the catcher position in most instances.

For operations where the catcher mechanism is moved only rarely, these prior art arrangements, with the above-noted disadvantages insofar as effort and personnel required to make changes in the longitudinal length adjustment, are not unduly burdensome. However, in small factory or shop operations where many small orders for a given length of cloth material are involved, it becomes necessary to make numerous adjustments of the position of the adjustable catcher, with the consequent increase in cost and effort required.

Further, with the above-noted prior art arrangements of the clamping mechanisms, provisions were not included for easily accommodating the stacking of a plurality of different lengths of similar cloth material, on top of one another, by the spreading machine. Since the folding and spreading operation is most times followed by a cutting operation, wherein the entire piles of layers of materials are cut into identical shapes by a cloth knife or saw, with relatively small orders involving different lengths of the same material, it is particularly desirable to be able to lay-out these lengths one on top of another, both for reasons of accommodating the next cutting operation, as well as because the spreader continuously carries the same bolt of material for the spreading operation and requires no adjustments. The capability to accommodate a plurality of lengths of the same material is especially useful for small orders for items such as various sized drapes or curtains for furnishing mobile homes, vans, or the like. Of course, the cloth spreading apparatus has many uses and the present invention increases the capability of any cloth spreading apparatus irrespective of the particular usage thereof.

The present invention is directed to solving the above-mentioned problems with respect to adjustable catchers for a cloth spreading machine. According to the invention, the moveable adjustable catcher is mounted on a carriage which has roller means for accommodating relatively frictionless longitudinal adjusting movement of the catcher. According to another important feature of the invention, braking or holding mechanisms are provided at the carriage which accommodate simultaneous single hand clamping of the catcher and catcher carriage at both sides of the cloth spreading table.

In preferred embodiments of the present invention, one lateral side of the catcher carriage includes a relatively rigid frame member extending longitudinally of the table and directly supporting rotatable carriage guide wheels that are guided in the same travel track as is the cloth spreader. Since this travel track at the spreading table is provided in any event for the spreader device, and is disposed in a proper, accurate longitudinal alignment with the edge of the table and the cloth laying surface, the provision of these guide wheels at the catcher carriage assures proper alignment of the catcher carriage and catcher in any of the adjusted positions. At the opposite lateral side of the catcher carriage, wheels engageable with the top surface of the table are provided, which wheels are spaced closer to one another since they do not have to serve the guiding function of the above-mentioned wheels, it being noted that the direct engagement with the upper surface of the table prevents that these wheels distort the alignment of the catcher carriage and catcher.

According to another feature of the preferred embodiments of the invention, the catcher carriage frame includes a lateral frame member extending laterally at an angle from the longer base frame at one side of the carriage accommodating the guide wheels to the other shorter side of the carriage, which lateral frame member is disposed spaced from the catcher mechanism and elevated from the table so as to accommodate both simple one-hand handling thereof by the operator, as well as to prevent interference with the existing folded cloth layers that may be disposed on the table.

Another important feature of preferred embodiments of the invention is the utilization of a braking or holding mechanism, which includes a single rotatable threaded member easily accessible from one side of the table for effecting clamping of the catcher carriage to both sides of the table to thereby form a firm and stable anchoring of the catcher carriage at a respective adjusted position. This braking mechanism in preferred embodiments includes a moveable brake shoe, which is slidably guided on a brake rod extending across the table, which moveable brake shoe is engaged directly by the screw threaded member in such a manner that the turning of this screw threaded member moves the moveable brake shoe against one side of the table simultaneously with movement of the brake rod extending across the table in the opposite direction so as to clamp a brake shoe at the brake rod at the other side of the table against the table, whereby the moveable brake shoe and the brake shoe at the brake rod form an effective clamp to the table. By rotatably mounting the moveable brake shoe to the threaded member and by loosely, slidably guiding the moveable brake member at the brake rod extending across the table, the braking and holding structure is simplified while assuring proper alignment of the brake shoes. The brake rod is slidably mounted in bearing blocks provided at frame members for the carriage at opposite sides of the table so as to assure a firm guidance of the brake rod. To facilitate moving of the carriage and catcher over already stacked piles of cloth so as to adjust to a shorter length of cloth without removing the cloth already stacked, this brake rod is disposed vertically above the table at a correspondingly sufficient distance.

A further feature of the present invention relates to a modification of the cloth clamping structure of the catcher so as to accommodate the mounting of the catcher with the carriage and the holding of the portions of the catcher extending across the table sufficiently high above the table to facilitate movement of the catcher over already stacked piles of cloth to a new shorter cloth length adjustment. The upper guide members attached directly to the clamping bar of the moveable catcher are extended above a guide rod, rather than below such guide rod as in the prior arrangements as exemplified by the above-noted U.S. Pat. No. 2,520,895. With this modification, the clamp can readily operate while also accommodating the high vertical position of the table.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
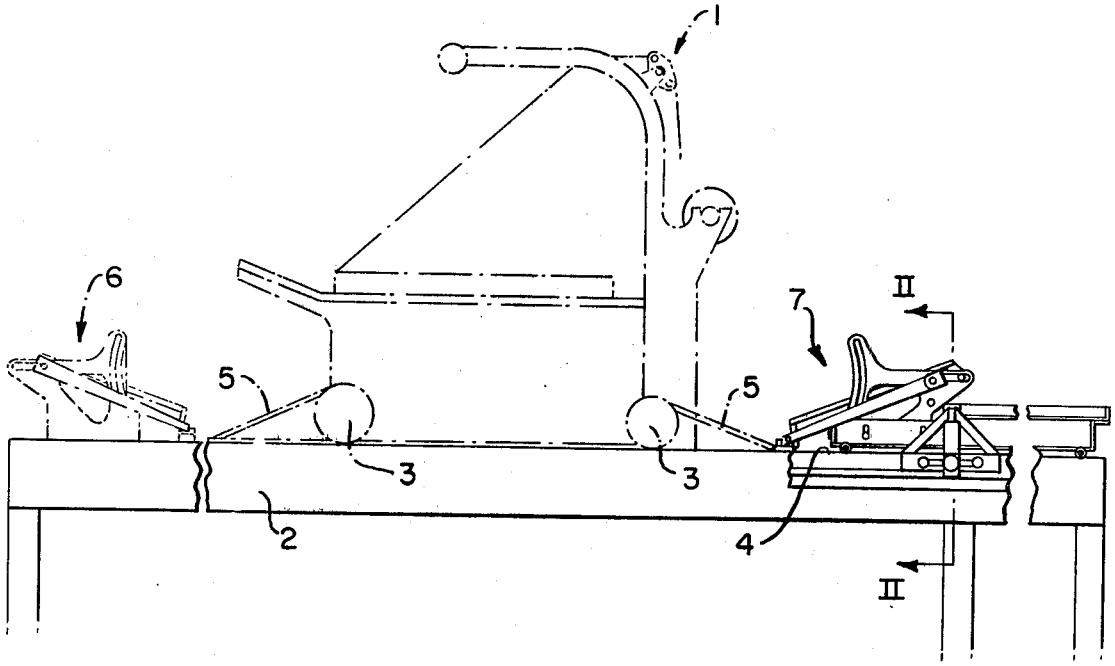
FIG. 1 is a schematic side view showing spreading apparatus including a cloth spreader and cloth catchers at opposite ends of a cloth spreading table, with the right-hand catcher being constructed in accordance with the present invention.

In the various drawing figures, like reference numerals are used to designate like parts.

Referring to FIG. 1, a cloth spreader 1 is movably mounted for movement along the upper surface of cloth spreading table 2 by way of wheels 3. These wheels 3 are guided at one side of the table in track 4 (see also FIG. 2 for a showing of track 4 which also guides the wheels of the catcher carriage, as will be described in more detail below). Since the details of the cloth spreading machine do not form a part of this invention, and since those skilled in the art can readily construct the same given the state of the art and the present disclosure, further details of same are not included herein. Attention is directed to the above-noted U.S. Pat. Nos. 2,520,895, and 3,622,146 as well as 3,540,720; 3,778,050, 3,051,475; and 2,659,597 for disclosures of cloth spreader mechanisms of the type that could be utilized in conjunction with the present invention. The illustrated cloth spreader 1 includes actuating members 5 at respective opposite ends thereof for actuating the catchers and reversing of the spreader as the spreader approaches the opposite ends of the travel path. These members 5 cooperate with the catchers to activate release of the catcher clamping mechanism so that the spreader can insert the next fold of cloth, with the catcher also including stop apparatus for reversing the direction of movement of the spreader, so that it can continuously travel in between catchers 6 and 7 as it lays down the superimposed layers of cloth.

The catcher 6, at the lefthand side of FIG. 1, may be of conventional relatively fixed construction and attached in a relatively fixed position by known means to the table 2.

Figure 2:
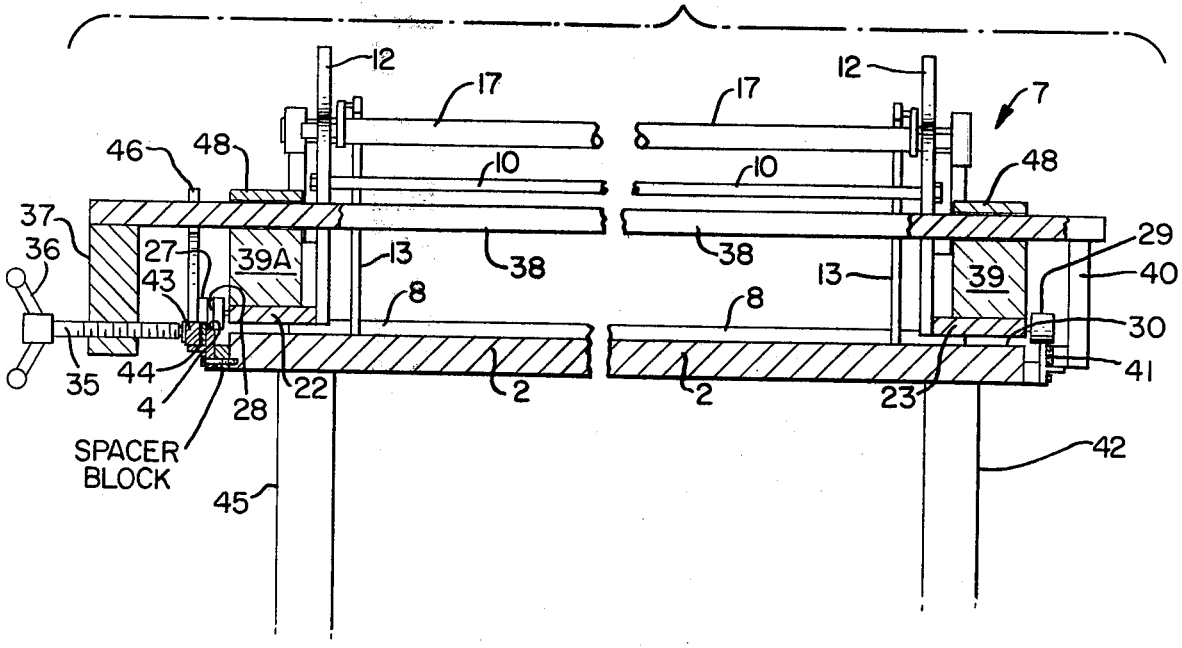
FIG. 2 is a sectional view taken along line II—II of FIG. 1 and separated in the middle to facilitate enlarged showing of the catcher and carriage construction at the table edges.
Figure 3:
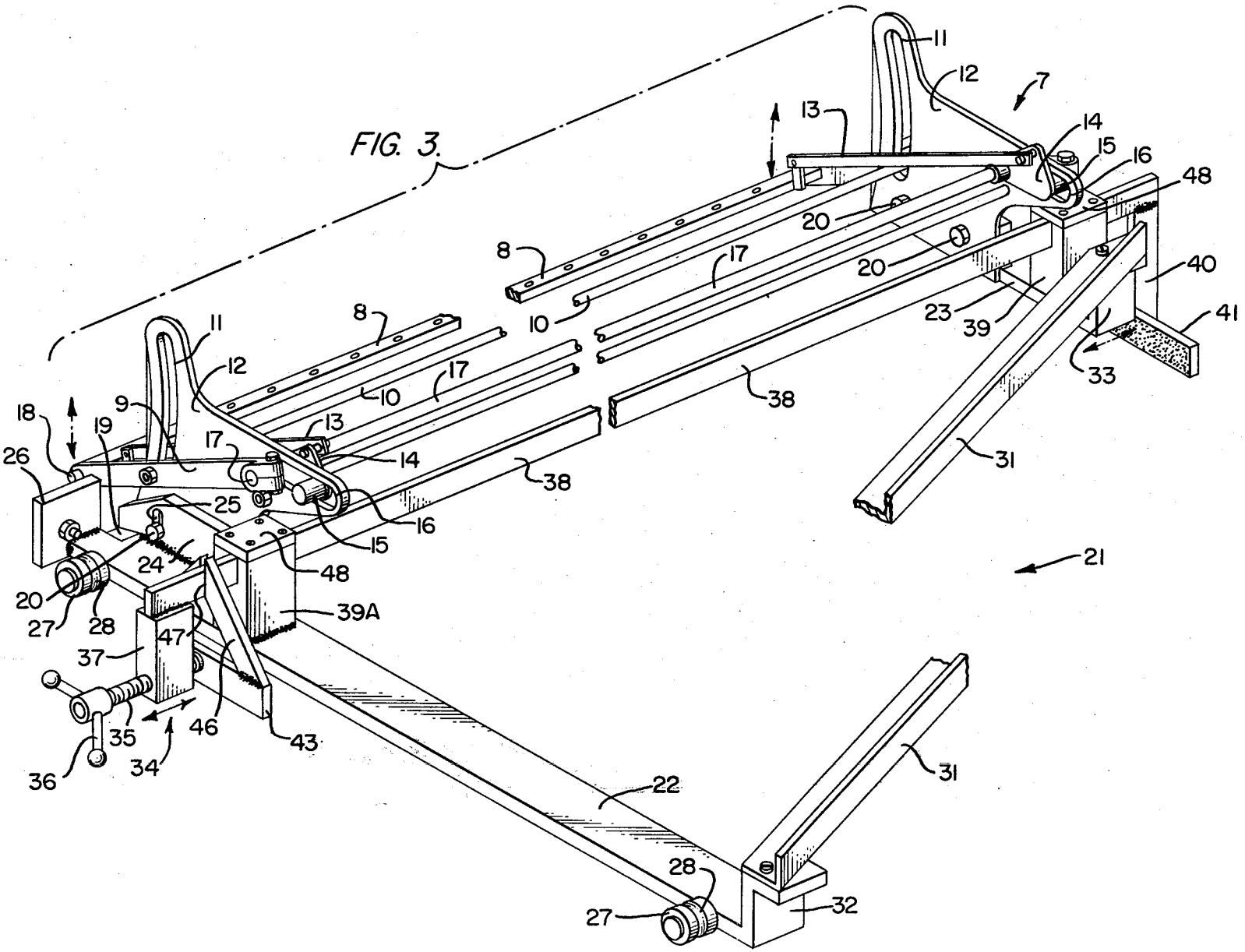
FIG. 3 is a prespective view showing the catcher and catcher carriage construction of the present invention and separated in the middle to facilitate enlarged showing of the catcher and carriage construction at the table edges.

The catcher 7, at the righthand side of the travel path of the spreader 1 as shown in FIG. 1, is shown in more detail in each of FIGS. 2 and 3. The catcher 7 includes a clamping bar 8 which is carried by support arms 9. The clamping bar 8 and support arms 9 are guided for movement by way of rod 10 engaged slidably in fixed slot 11 of the fixed brackets 12 to assure parallel movement of clamping bar 8. Guide arms 13 are also attached to clamp bar 8 and to triangular brackets 14, which triangular brackets 14 in turn are guided via their pins 15 in longitudinally extending slot 16 of the fixed brackets 12. These triangular brackets 14 also include a bearing support for pivot member 17 attached to the levers 9. In operation of the catcher 7, the lever members 5 of the spreader 1 engage and lift the bar 8 by way of engagement members 18, it being noted that the ends of levers 5 travel along cam paths 19 of the frame supporting the catcher 7.

The catcher 7 differs from fixed catcher 6 in that the guide arms 13 in catcher 6 extend above rather than underneath rod 10. Also, to accommodate this change in connection of guide arms 13, triangular brackets 14 in catcher 6 are turned over in catcher 6. This modification of catcher 7 (catcher 6 being of conventional construction) makes it possible to dispose those portions of catcher 7 that extend across the table at a sufficient height to accommodate movement of catcher 7 over already stacked layers of cloth for a shorter cloth layer adjustment without interrupting the operation of the clamp bar 8.

To accommodate easy longitudinal adjustment movement and affixing of the catcher 7, the catcher is mounted by bolts 20 to a carriage 21. The carriage 21 includes a frame having a rigid plate member 22 extending along the one side of the table 2, and a corresponding shorter frame member 23 extending along the other side of the table 2. Mounted on frame member 22 by welding is a vertically extending plate part 24, which includes vertical slots 25 for accommodating vertical adjustment of the connection between the catcher 7 and the carriage 21. At the forward end of frame member 22, a plate 26 is provided which serves as a stop and reversing plate engageable with a part of the spreader 1 during its travel path to assist a reversing sequence for the spreader 1. To accommodate easy rolling movement of the carriage 21, guide wheels 27 are rotatably mounted at the frame member 22. These guide wheels 27 include a central guide groove portion 28 which is engageable with the guide track 4 for the spreader in such a manner that the carriage 21 is always maintained in a proper orientation with respect to the lateral extent of the table, it being noted that carriage wheels 29 (two of which are provided longitudinally spaced from one another) at the opposite side of the carriage and attached to plate member 23 engage directly at the flat horizontal surface 30 of the table 2 so that they do not distort the guiding function of the guide wheels 27. Since the guide wheels 27 are displaced longitudinally from one another by a substantial amount, they can more readily carry out their guiding function. A transverse frame member 31 is fixably connected at respective ends of plate members 22 and 23 so as to form a rigid interconnecting transverse frame, as well as an easily grasped handle for the operator to move the carriage. This transverse frame member 31 is maintained at a vertical spacing by portions 32 and 33 of the respective frame members 22 and 23, so as to accommodate movement of the carriage 21 and catcher 7 along the table even with a pile of stacked cloth intermediate the members 22 and 23.

A carriage holding or braking mechanism 34 is provided. Holding brake 34 includes a threaded member 35 attached to a manually rotatable handle 36 and screw threadably connected to brake rod block 37. Brake rod block 37 is rigidly connected by welding to brake rod 38 which extends across the lateral extent of the table and is slidably supported in brake rod guide block 39. Fixedly attached to the extreme end of brake rod 38 is a downwardly depending rod 40, which rod 40 has fixed thereto a brake pad 41, which is engageable with the side surface 42 of the table 2.

Moveable brake shoe member 43 is rotatably attached to the end of threaded member 35 so as to move axially therewith. This brake shoe member 43 includes a brake shoe surface or pad 44 which is clampingly engageable with side surface 45 of the table 2. Member 43 includes fixed guide member portions 46 which are spaced from one another at a central portion thereof to form a guide slot 47 through which passes the brake rod 38 in a loose manner. This guide slot 47 serves the purpose of aligning brake shoe member 43 in a proper position during rotation of the shoe threaded member 35. Additionally, guide 43 and guide members 46 provide longitudinal support to brake rod 38 during engagement of the spreader mechanism 1 with the catcher 7 while the carriage 21 is held in fixed longitudinal position with respect to table 2 by the holding brake 34. The brake rod 38 itself is slidably guided in the brake rod guide blocks 39 and 39A. In order to accommodate removal of the braking structure, the blocks 39, 39A are provided with screw threadably attached cover members 48. Brake pads 41 and 44 are made of high coefficient friction materials such as rubber or the like and are attached by gluing or the like.

Although the operation of the catcher 7 and carriage 21 of the present invention should be readily apparent from the above description, following is a brief description of the adjustment operation utilizing this apparatus. Assume that the catcher 7 is fixed in an adjusted position along the length of the table 2, and it is desired to change this adjusted position. First, the operator lifts clamp bar 8 to disengage same from the superimposed cloth layers and rotates handle 36 to simultaneously release the clamping action of brake shoe members 41 and 43 against the respective opposite sides of the table, whereby the carriage 21 becomes freely moveable on rollers 27, 29. The operator then need merely grasp the transverse support member 31 and move the carriage 21 and attached catcher 7 to the desired new adjustment position. Assuming that a relatively long fold of material has been already piled by the spreading mechanism, the vertical disposition of the carriage and catch mechanism structure accommodates movement of the catcher 7 over the piled cloth to establish a shorter length for the cloth layers. Once the carriage 21 and catcher 7 are at a predetermined desired position, the operator need merely steady the carriage with the hand at 31, while utilizing the other hand to clampingly brake and hold the carriage to the table by the rotation of the single handle 36. Since the cooperation of grooves 28 of the two guide wheels 27 and the guide track 4 assure proper transverse alignment of the carriage and catcher mechanism, the operator need not be concerned with attempting to align the respective opposite lateral ends of the catcher mechanism during the adjustment process, but need merely move the entire carriage and catcher in a simple one-person operation.

The apparatus of the present invention is particularly useful in operations, wherein a plurality of different lengths of the same material are to be used, such as, for example, for making different size drapery and/or curtains for a home, a recreation vehicle, a van, or the like. With a table forty or more feet long, the spreading apparatus utilizing an easily adjustable catcher 7 as in the preferred embodiment of the invention can first lay several dozen layers of cloth of one length, followed by movement and adjustment of catcher 7 to a shorter length position so that the same supply of cloth on the spreader can be laid out on the table to accommodate different sized drapes of a single material.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Cloth spreading apparatus comprising:

a table, a catcher carriage guide track fixedly disposed on said table and extending longitudinally thereof, a cloth spreader reciprocally movable along the length of the table and including means for laying down superimposed layers of cloth on said table with reversing folds in said cloth at respective ends of the travel path of the spreader, a pair of cloth catching devices disposed at the respective ends of the travel path of said spreader and including movable cloth clamping means for selectively clamping said cloth at the table while said cloth spreader travels intermediate said catching devices laying down said layers, and a catcher carriage supportingly carrying one of said catching devices for movement between a plurality of operating positions along the length of the table, said catcher carriage means including:

rigid frame means rigidly connected to said one catching device said rigid frame means including first and second longitudinally extending frame members disposed at respective opposite lateral sides of said one catching device, and a transverse frame member interconnecting said first and second frame member, catcher carriage guide means engageable in said catcher carriage guide track for continuously maintaining said catcher carriage and said one catching device in proper alignment with said table and cloth spreader for all adjusted positions of said one catching device along the length of the table, and releasable carriage holding means for releasably holding said catcher carriage in respective adjusted positions along the length of the table, wherein said releasable carriage holding means is operable from one side of said table and wherein all portions of said carriage which extend transversely of said table across portions covered by layers of materials during cloth spreading by said cloth spreader are disposed sufficiently above the level of the table to accommodate movement of said catcher carriage and catcher to positions for spreading layers of shorter length on existing longer length layers of cloth utilizing a continuous bolt of cloth on said cloth spreader, wherein said catcher carriage includes carriage wheel means arranged at respective opposite sides of said carriage for accomodating relatively frictionless longitudinal adjusting movement of the catcher carriage along said table independently of the cloth spreader, and wherein said catcher carriage guide means includes portions of said carriage wheel means, wherein said first frame member has opposite longitudinal ends and is substantially longer than said second frame member, wherein said carriage wheels means includes first and second guide wheels bearingly supported adjacent respective opposite longitudinal ends of said first frame member, and wherein said guide wheels are guidingly engageable in said catcher carriage guiding track to continuously maintain said catcher carriage in said proper alignment with said table and cloth spreader.

2. Apparatus according to claim 1, wherein said carriage wheel means further includes at least one support wheel bearingly supported at said second frame member, said at least one support wheel being engageable with a flat horizontal upwardly facing surface of the table with no lateral guiding forces being transmitted between said table and said at least one support wheel, whereby guidance of said catcher carriage is exclusively by way of said first and second guide wheels.

3. Apparatus according to claim 1, wherein said catcher carriage guide track serves also as a guide track for wheels of said cloth spreader.

4. Apparatus according to claim 1, wherein said holding means includes a single hand operable handle for simultaneously clampingly engaging both sides of said table to said carriage.

5. Apparatus according to claim 4, wherein said holding means includes:

a brake rod extending across said table, a brake pad fixed at one end of said brake rod, a threaded block at the other end of said brake rod, a rotatable screw threaded member threadably engaged in said threaded block, and a moveable brake shoe axially moveable with said screw threaded member and engageable with the other side of said table so as to clamp the table between said brake shoes upon rotation of the threaded member.

6. Apparatus according to claim 1, wherein means are provided for accommodating vertical adjustment of catcher clamping structure of said one of said catching devices with respect to the carriage.

7. Cloth spreading apparatus comprising:

a table, a cloth spreader reciprocally movable along the length of the table and including means for laying down superimposed layers of cloth on said table with reversing folds in said cloth at respective ends of the travel path of the spreader, a pair of cloth catching devices disposed at the respective ends of the travel path of said spreader and including movable cloth clamping means for selectively clamping said cloth at the table while said cloth spreader travels intermediate said catching devices laying down said layers, and catcher carriage means attached to one of said catching devices, said catcher carriage means including a roller means for accomodating easy longitudinal adjusting movement of said catcher carriage means and releasable carriage holding means for releasably holding said carriage in respective adjusted positions along the length of the table, wherein the catching device attached to said catcher carriage includes guide arms attached to a cloth clamping bar which are disposed above a transversely extending guide rod that travels in curved guide slots at support brackets at opposite sides of said table, and wherein the other catching device has corresponding guide arms disposed below a corresponding guide rod, and wherein the carriage includes a frame having a relatively long rigid frame member extending along one side of the table, a relatively short rigid frame member extending along the other side of the table, and a transverse rigid frame member also serving as a handle attached to said long and short frame members.

8. Apparatus according to claim 7, wherein said transverse frame member is disposed substantially spaced from the table so as to accommodate movement of the carriage over a stack of cloth layers.

9. A carriage apparatus for use with a cloth spreader reciprocably movable along the length of a table and having means for laying down superimposed layers of cloth on said table with reversing folds in said cloth at respective ends of the travel path of the spreader and having catcher apparatus at one end of the travel path of said spreader for selectively clamping said cloth at the table, said carriage apparatus comprising:

a carriage apparatus including roller means for accommodating easy longitudinal adjusting movement of such carriage apparatus and releasable carriage holding means for releasably holding said carriage in respective adjusted positions along the length of the table, wherein said holding means includes a single hand operable handle for simultaneously clampingly engaging both sides of said table to said carriage, wherein said holding means includes:

a brake rod extending across said table, a brake pad fixed at one end of said brake rod, a threaded block at the other end of said brake rod, a rotatable screw threaded member threadably engaged in said threaded block, and a movable brake shoe axially movable with said screw threaded member and engageable with the other side of said table so as to clamp the table between said brake shoes upon rotation of the threaded member, and wherein the carriage includes a frame having a relatively long rigid frame member extending along one side of the table, a relatively short rigid frame member extending along the other side of the table, and a transverse rigid frame member also serving as a handle attached to said long and short frame members, and wherein a brake rod guide block is fixed to each of said long and short frame members, said guide blocks including guide slots for slidably guiding said brake rod.

10. Apparatus according to claim 9, wherein detachable cover members are provided at the top of each of the guide slots, whereby removal of said cover members permits unrestricted upward removal of the brake rod and attached threaded member and brake shoes.

11. Cloth spreading apparatus comprising:

a table, a cloth spreader reciprocally movable along the length of the table and including means for laying down superimposed layers of cloth on said table with reversing folds in said cloth at respective ends of the travel path of the spreader, a pair of cloth catching devices disposed at the respective ends of the travel path of said spreader and including movable cloth clamping means for selectively clamping said cloth at the table while said cloth spreader travels intermediate said catching devices laying down said layers, catcher carriage means attached to one of said catching devices, said catcher carriage means including roller means for accommodating easy longitudinal adjusting movement of said catcher carriage means and releasable carriage holding means for releasably holding said carriage in respective adjusted positions along the length of the table, wherein said holding means includes a single hand operable handle for simultaneously clampingly engaging both sides of said table to said carriage, wherein said holding means includes:

a brake rod extending across said table, a brake pad fixed at one end of said brake rod, a threaded block at the other end of said brake rod, a rotatable screw threaded member threadably engaged in said threaded block, and a movable brake shoe axially movable with said screw threaded member and engageable with the other side of said table so as to clamp the table between said brake shoes upon rotation of the threaded member, and wherein rigid guide rods are connected to said movable brake shoe, said rigid guide rods being spaced from one another to form a guide slot through which extends said brake rod, whereby said brake rod and guide rods maintain said movable brake shoe in alignment with the side surface of the table to be clamped.

12. Apparatus according to claim 11, wherein the carriage includes a frame having a relatively long rigid frame member extending along one side of the table, a relatively short rigid frame member extending along the other side of the table, and a transverse rigid frame member also serving as a handle attached to said long and short frame members.

13. Apparatus according to claim 12, wherein said transverse frame member is disposed substantially spaced from the table so as to accommodate movement of the carriage over a stack of cloth layers.

14. Apparatus according to claim 13, wherein said brake rod, said transverse frame member and said long and short frame members together form a rigid frame support structure for said catcher when said holding means is engaged with said brake pads clamping the sides of the table.

15. Cloth spreading apparatus comprising:

a table, a cloth spreader reciprocally movable along the length of the table and including means for laying down superimposed layers of cloth on said table with reversing folds in said cloth at respective ends of the travel path of the spreader, a pair of cloth catching devices disposed at the respective ends of the travel path of said spreader and including movable cloth clamping means for selectively clamping said cloth at the table while said cloth spreader travels intermediate said catching devices laying down said layers, catcher carriage means attached to one of said catching devices, said catcher carriage means including roller means for accommodating easy longitudinal adjusting movement of said catcher carriage means and releasable carriage holding means for releasably holding said carriage in respective adjusted positions along the length of the table, wherein said holding means includes a single hand operable handle for simultaneously clampingly engaging both sides of said table to said carriage, wherein said holding means includes:

a brake rod extending across said table, a brake pad fixed at one end of said brake rod, a threaded block at the other end of said brake rod, a rotatable screw threaded member threadably engaged in said threaded block, and a movable brake shoe axially movable with said screw threaded member and engageable with the other side of said table so as to clamp the table between said brake shoes upon rotation of the threaded member, and wherein the carriage includes a frame having a relatively long rigid frame member extending along one side of the table, a relatively short rigid frame member extending along the other side of the table, and a transverse rigid frame member also serving as a handle attached to said long and short frame members, and wherein a brake rod guide block is fixed to each of said long and short frame members, said guide blocks including guide slots for slidably guiding said brake rod.

16. Apparatus according to claim 15, wherein detachable cover members are provided at a top portion of each of the guide slots, whereby removal of said cover members permits unrestricted upward removal of the brake rod and attached threaded member and brake shoes.

17. Apparatus according to claim 16, wherein said long and short frame members are flat steel pieces bent up at respective rearward ends thereof and wherein said transverse frame member is an L-shaped cross-section steel member threadedly attached to the respective rearward ends of said long and short frame members.

18. Cloth spreading apparatus comprising:

a table, a catcher carriage guide track fixedly disposed on said table and extending longitudinally thereof, a cloth spreader reciprocally movable along the length of the table and including means for laying down superimposed layers of cloth on said table with reversing folds in said cloth at respective ends of the travel path of the spreader, a pair of cloth catching devices disposed at the respective ends of the travel path of said spreader and including movable cloth clamping means for selectively clamping said cloth at the table while said cloth spreader travels intermediate said catching devices laying down said layers, and a catcher carriage supportingly carrying one of said catching devices for movement between a plurality of operating positions along the length of the table, said catcher carriage including:

rigid frame means rigidly connected to said one catching device, said rigid frame means including first and second longitudinally extending frame members disposed at respective opposite lateral sides of said one catching device and a transverse frame member rigidly interconnecting said first and second frame members, catcher carriage guide means engageable in said catcher carriage guide track for continuously maintaining said catcher carriage and said one catching device in proper alignment with said table and cloth spreader for all adjusted positions of said one catching device along the length of the table, and releasable carriage holding means for releasably holding said catcher carriage in respective adjusted positions along the length of the table, wherein said catcher carriage includes carriage wheel means arranged at respective opposite sides of said carriage for accommodating relatively frictionless longitudinal adjusting movement of the catcher carriage along said table independently of the cloth spreader, wherein said first frame member has opposite longitudinal ends and is substantially longer than said second frame member, wherein said carriage wheel means includes first and second guide wheels bearingly supported adjacent respective opposite longitudinal ends of said first frame member, and wherein said guide wheels are guidingly engageable in said catcher carriage guide track to continuously maintain said catcher carriage in said proper alignment with said table and cloth spreader.

19. Apparatus according to claim 18, wherein said carriage wheel means further includes at least one support wheel bearingly supported at said second frame member, said at least one support wheel being engageable with a flat horizontal upwardly facing surface of the table with no lateral guiding forces being transmitted between said table and said at least one support wheel, whereby guidance of said catcher carriage is exclusively by way of said first and second guide wheels.

20. Apparatus according to claim 19, wherein said catcher carriage guide track serves also as a guide track for wheels of said cloth spreader.

21. Apparatus according to claim 18, wherein said holding means includes a single hand operable handle for simultaneously clampingly engaging both sides of said table to said carriage.

22. Apparatus according to claim 21, wherein said holding means includes:

a brake rod extending across said table, a brake pad fixed at one end of said brake rod, a threaded block at the other end of said brake rod, a rotatable screw threaded member threadably engaged in said threaded block, and a moveable brake shoe axially moveable with said screw threaded member and engageable with the other side of said table so as to clamp the table between said brake shoes upon rotation of the threaded member.

23. Cloth catching apparatus for use with a cloth spreader reciprocably movable along the length of a table and having means for laying down superimposed layers of cloth on said table with reversing folds in said cloth at respective ends of the travel path of the spreader, said catching apparatus comprising:

a cloth catching device disposed at one end of the travel path of said spreader and including movable cloth clamping means for selectively clamping said cloth at the table while said cloth spreader lays down said layers, and catcher carriage means attached to said catching device, said catcher carriage means including roller means for accommodating easy longitudinal adjusting movement of such catcher carriage means and releasable carriage holding means for releasably holding said carriage in respective adjusted positions along the length of the table, wherein said holding means includes a single hand operable handle for simultaneously clampingly engaging both sides of said table to said carriage, wherein said holding means includes:

a brake rod extending across the table, a brake pad fixed at one end of said brake rod, a threaded block at the other end of said brake rod, a rotatable screw threaded member threadably engaged in said threaded block, and a movable brake shoe axially movable with said screw threaded member and engageable with the other side of said table so as to clamp the table between said brake shoes upon rotation of the threaded member, and wherein the carriage includes a frame having a relatively long rigid frame member extending along one side of the table, a relatively short rigid frame member extending along the other side of the table, and a transverse rigid frame member also serving as a handle attached to said long and short frame members, and wherein a brake rod guide block is fixed to each of said long and short frame members, said guide blocks including guide slots for slidably guiding said brake rod.

24. Apparatus according to claim 23 wherein detachable cover members are provided at a part of each of the guide slots, whereby removal of said cover members permits unrestricted upward removal of the brake and attached threaded member and brake shoes.

25. A catcher carriage for use with cloth spreading apparatus of the type having a cloth spreader reciprocably movable along the length of a table and having means for laying down superimposed layers of cloth on said table with reversing folds in said cloth at respective ends of the travel path of the spreader and having a catching deviced at at least one end of the travel path of said spreader for selectively clamping said cloth at the table, said catcher carriage being detachably attachable to said catching device for supportably carrying said catching device for movement between a plurality of operating positions along the length of a table, said catcher carriage including:

rigid frame means rigidly connectible to said catching device, said rigid frame means including first and second longitudinally extending frame members disposed at respective opposite lateral sides of said carriage and a transverse frame member rigidly interconnecting said first and second frame members, catcher carriage guide means engageable in a guide track for continuously maintaining the catcher carriage in alignment with said table and cloth spreader for all adjusted positions of said catcher carriage along the length of the table, and releasable carriage holding means for releasably holding said catcher carriage in respective adjusted positions along the length of the table, wherein said catcher carriage includes carriage wheel means arranged at respective opposite sides of said carriage for accommodating relatively frictionless longitudinal adjusting movement of the catcher carriage along a table, wherein said catcher carriage guide means includes portions of said carriage wheel means, wherein said first frame member has opposite longitudinal ends and is substantially longer than said second frame member, wherein said carriage wheel means includes first and second guide wheels bearingly supported adjacent respective opposite longitudinal ends of said first frame member, and wherein said guide wheels are guidingly engageable in a catcher carriage guide track.

26. Apparatus according to claim 25, wherein said carriage wheel means further includes at least one support wheel bearingly supported at said second frame member, said at least one support wheel being engageable with a flat horizontal upwardly facing surface of the table with no lateral guiding forces being transmitted between said table and said at least one support wheel, whereby guidance of said catcher carriage is exclusively by way of said first and second guide wheels.

27. Apparatus according to claim 26, wherein said catcher carriage guide track serves also as a guide track for wheels of said cloth spreader.

28. Apparatus according to claim 25, wherein said holding means includes a single hand operable handle for simultaneously clampingly engaging both sides of said table to said carriage.

29. Apparatus according to claim 28, wherein said holding means includes:

a brake rod extending across said table, a brake pad fixed at one end of said brake rod, a threaded block at the other end of said brake rod, a rotatable screw threaded member threadably engaged in said threaded block, and a moveable brake shoe axially moveable with said screw threaded member and engageable with the other side of said table so as to clamp the table between said brake shoes uponrotation of the threaded member.

30. Apparatus according to claim 25, further comprising a cloth catcher fixedly attached to said frame means.

31. A carriage apparatus for use with a cloth spreader reciprocably movable along the length of a table and having means for laying down superimposed layers of cloth on said table with reversing folds in said cloth at respective ends of the travel path of the spreader and having catcher apparatus at one end of the travel path of said spreader for selectively clamping said cloth at the table, said carriage apparatus comprising:

a carriage apparatus including roller means for accommodating easy longitudinal adjusting movement of such carriage apparatus and releasable carriage holding means for releasably holding said carriage in respective adjusted positions along the length of the table, wherein said holding means includes a single hand operable handle for simultaneously clampingly engaging both sides of said table to said carriage, wherein said holding means includes:

a brake rod extending across said table, a brake pad fixed at one end of said brake rod, a threaded block at the other end of said brake rod, a rotatable screw threaded member threadably engaged in said threaded block, and a movable brake shoe axially movable with said screw threaded member and engageable with the other side of said table so as to clamp the table between said brake shoes upon rotation of the threaded member, wherein said movable brake shoe is rotatably attached to said screw threaded member and includes fixed guide member portions which are spaced from one another at a central portion thereof to form a guide slot through which passes the brake rod in a loose manner with said guide slot serving the purpose of aligning the movable brake shoe during rotation of the screw threaded member.

* * * * *